US008246126B1

(12) United States Patent
Weber

(10) Patent No.: US 8,246,126 B1
(45) Date of Patent: Aug. 21, 2012

(54) CABINET WITH SLIDING CLOSURE PANEL

(76) Inventor: Ralph Johannes Weber, Victor, NY (US)

( * ) Notice: Subject to any disclaimer, the term of this patent is extended or adjusted under 35 U.S.C. 154(b) by 925 days.

(21) Appl. No.: 12/231,765

(22) Filed: Sep. 5, 2008

Related U.S. Application Data

(60) Provisional application No. 61/009,040, filed on Dec. 26, 2007, provisional application No. 60/999,556, filed on Oct. 19, 2007.

(51) Int. Cl.
*A47B 67/00* (2006.01)

(52) U.S. Cl. ..... 312/227; 312/245; 359/872

(58) Field of Classification Search ..... 312/245, 312/246, 224, 226, 227, 302, 303, 310; 248/474, 248/476, 477, 478, 479, 480; 359/871, 872, 359/875, 882
See application file for complete search history.

(56) References Cited

U.S. PATENT DOCUMENTS

| | | | | | |
|---|---|---|---|---|---|
| 112,083 | A | * | 2/1871 | Shaw | 312/201 |
| 577,204 | A | * | 2/1897 | Patten | 312/213 |
| 600,742 | A | * | 3/1898 | Porter | 312/226 |
| 1,661,899 | A | * | 3/1928 | Martens | 248/485 |
| 1,776,464 | A | * | 9/1930 | Blackman | 312/227 |
| 1,876,407 | A | * | 9/1932 | Frazier | 312/227 |
| 2,239,487 | A | * | 4/1941 | Fulton | 248/485 |
| 3,176,942 | A | * | 4/1965 | Mitchell et al. | 248/487 |
| 3,885,844 | A | * | 5/1975 | Schneider | 312/227 |
| 4,066,306 | A | * | 1/1978 | Klinder | 312/224 |
| 4,602,855 | A | | 7/1986 | Frey | |
| 5,466,060 | A | | 11/1995 | Hoffmann | |
| 5,685,515 | A | | 11/1997 | Hoernig | |
| 6,152,549 | A | | 11/2000 | Goto et al. | |
| D471,048 | S | | 3/2003 | Platt | |
| 6,805,418 | B2 | | 10/2004 | Milligan | |
| 7,290,892 | B2 | | 11/2007 | Shieh | |
| 2004/0027039 | A1 | * | 2/2004 | Delph | 312/334.25 |
| 2005/0206279 | A1 | * | 9/2005 | Lilly | 312/204 |

FOREIGN PATENT DOCUMENTS

CH 621933 * 3/1981

OTHER PUBLICATIONS

"Kohler Mirrored Cabinetry" Brochure, copyright 2007, by Kohler Co., showing various single and double hinge door mirrored medicine cabinet designs.

(Continued)

*Primary Examiner* — James O Hansen

(57) ABSTRACT

Provided are cabinets, methods of making the cabinets, and methods of using the cabinets. One embodiment of the cabinet includes an enclosure and at least one horizontally slidable closure panel interconnected to the enclosure with a first fully extendible concealed rail slide assembly mounted proximate the top of the enclosure and a second fully extendible concealed rail slide assembly mounted proximate the bottom of the enclosure. Another embodiment of the cabinet includes an enclosure, at least one enclosure cover plate, at least one horizontally slidable and vertically angularly adjustable closure panel interconnected to the enclosure with a first fully extendible concealed rail slide assembly mounted proximate the top of the at least one enclosure cover plate and a second fully extendible concealed rail slide assembly mounted proximate the bottom of the enclosure or the at least one enclosure cover plate, and an angular adjustment mechanism for vertically tilting the least one horizontally slidable and vertically angularly adjustable closure panel. The cabinets disclosed herein are particularly advantageous for use by non-ambulatory people due to compliance with Americans with Disabilities Act (ADA) accessibility guidelines.

13 Claims, 16 Drawing Sheets

OTHER PUBLICATIONS

"Justime" 2007 product catalog; p. 44,product 6867-77, Swivel Mirror, p. 80, product 6811-77 Sliding Mirror Cabinet.

"Quick Reference Guide, Maax Medicine Cabinets" , showing single panel, double panel and triple panel hinged medicine cabinet designs and swivel mirrors.

Website for 800AFaucet, http://www.800afaucet.com/TProductDetail.aspx?ProductID=3008, showing Kohler Model: Koh-K-3092.

Website for Kitchensource, http://www.kitchensource.com/bathroom-mirrors/pdf/ha-hewilifesystem-04.pdf, specification sheet showing HEWI Lifesystems Adjustable Mirror.

Live Well Medical website, http://www.livewellmedical.com/index.php? main_page=index&cPath=243 &gclid=CP63rvTyqJICFQUIHgod4C7PLw, showing 2 styles of mirror designed for ADA compliance; fixed angle Model 108-0535-1 and adjustable tilt model 108-0600t-1.

Scheider website, http://www.wschneider.com/productList.do?portal=UK&language=en&type=mirror&filterLine=PEAKLINE, showing Peakline product. Mirror fixed with sliding shelves.

Alibaba website http://www.alibaba.com/catalog/11407634/Cabinet/showimg.html, showing Home Member Company Ltd. surface mount cabinet with slide panel and exposed rail.

AntiquePlumbing.net website http://www.antiqueplumbing.net/mimimecachbr2.html showing a surface mount cabinet with bearing slide exposed.

PCS Bath Website http://www.pscbath.com/product_details.php-?pid=2699 showing product RAB-AB201-SC497, swivel and sliding mirror with exposed slide rails.

Lowes Website http://www.lowes.com/lowes/lkn?action=productDetail&productId=23716-336-N323LP/701L &lpage=none showing Zenith Model: N323LP/701L surface mount medicine cabinet with overlapping mirrors in integral tracks.

* cited by examiner

CABINET WITH SLIDING CLOSURE PANEL

CROSS-REFERENCE TO RELATED APPLICATIONS

This application claims priority to U.S. Provisional Application Ser. No. 60/999,556 filed on Oct. 19, 2007 and U.S. Provisional Application Ser. No. 61/009,040 filed on Dec. 26, 2007, both of which are herein incorporated by reference in their entirety.

FIELD

The present disclosure relates to cabinets. More particularly, the present disclosure relates to cabinets with an enclosure panel mounting system in which the panel is mounted on a concealed, horizontally adjustable full extension rail system to provide full, unobstructed access to the contents of the enclosure. The present disclosure also relates to a system for mounting the panel to the cabinet to provide the user with adjustability of the panel's normal viewing angle.

BACKGROUND

Prior art surface and recess wall mounted cabinets are available in a few general configurations with regard to the mechanism for mounting the surface panel to the cabinet enclosure. In one configuration, the enclosure surface panel or mirror is mounted to the enclosure with a single long hinge or a plurality of hinges on either the left or the right side of the cabinet enclosure. The door swings towards the user to access the inside of the cabinet. Such hinged type panel mounting systems have limitations when used with large panels or mirrors in small rooms with limited space and in locations where the arc travel of the panel interferes with other fixtures in the space such as tall faucets or hanging lighting fixtures. For example, such a hinged mounting system when used in a bathroom for a mirrored medicine cabinet does not allow for hanging lighting fixtures or for mounting tall plumbing fixtures due to interference with the travel path of the mirrored panel when in the open position. One conventional approach to resolving this issue is the use of a cabinet with a series of smaller segmented mirrored panels, each with its own hinge assembly. The drawbacks of this system are a discontinuous reflective surface and incremental cost and complexity associated with the design and fabrication.

In another configuration for prior art cabinets, the enclosure surface panel or mirror is mounted within the enclosure with slotted grooves or slide rails. With these configurations, the surface panel does not extend out beyond the enclosure, and therefore two or more surface panels are needed to completely cover the enclosure. This configuration also suffers in terms of a discontinuous reflective surface as well as limiting the user access to one portion of the enclosure at a given time as opposed to complete enclosure access.

In yet another configuration for prior art cabinets, the enclosure surface panel or mirror is mounted with an integrated slide system for providing complete access to the enclosure. However, such systems suffer from exposed slide or rail assemblies, and also require surface mounting. The bearing units for the slide or rail assemblies are exposed and no channel endcaps are included to obscure the rail ends. The cabinet cannot be recessed into a wall.

These prior art cabinet panel enclosure designs for use in bathroom cabinets also suffer from a design perspective for use by non-ambulatory people. More particularly, they are not specifically designed for disability/wheelchair accessibility, and therefore for the most part do not comply with ADAAG (Americans with Disabilities Act (ADA) Accessibility Guidelines) for mirrors (Section 4.19 & 4.19.6) and controls (Section 4.27). In addition, few of these prior art designs have the ability for the mirror to be tilted by non-ambulatory people. Prior art designs that do incorporate mirror angle adjustability suffer in having mirror tilt adjustment mechanisms that are not easily adjustable by people in wheelchairs. In one prior art angular adjustable mirror design, the mirror pivots about its vertical midpoint to permit improved ease of adjustment. However, this design requires pushing the reflective surface in to achieve a lower reflective angle, which requires more clearance towards the bottom of the mirror to accommodate this travel.

Hence, a need exists for a cabinet with an improved closure panel mounting system that is concealed and fully extends beyond the cavity of the enclosure, and optionally includes an improved system for angular adjustability of the closure panel. Such a cabinet would be particularly beneficial for use by non-ambulatory people.

SUMMARY

According to the present disclosure, an advantageous cabinet comprises an enclosure and at least one horizontally slidable closure panel interconnected to the enclosure with a first fully extendible concealed rail slide assembly mounted proximate the top of the enclosure and a second fully extendible concealed rail slide assembly mounted proximate the bottom of the enclosure.

A further aspect of the present disclosure relates to an advantageous cabinet comprising an enclosure, at least one enclosure cover plate, at least one horizontally slidable and vertically angularly adjustable closure panel interconnected to the enclosure with a first fully extendible concealed rail slide assembly mounted proximate the top of the at least one enclosure cover plate and a second fully extendible concealed rail slide assembly mounted proximate the bottom of the enclosure or the at least one enclosure cover plate, and an angular adjustment mechanism for vertically tilting the least one horizontally slidable and vertically angularly adjustable closure panel.

These and other features and attributes of the disclosed cabinet and methods of making and using such a cabinet will be apparent from the detailed description which follows, particularly when read in conjunction with the figures appended hereto.

BRIEF DESCRIPTION OF DRAWINGS

To assist those of ordinary skill in the relevant art in making and using the subject matter hereof, reference is made to the appended drawings, wherein.

DETAILED DESCRIPTION

Figure 1:
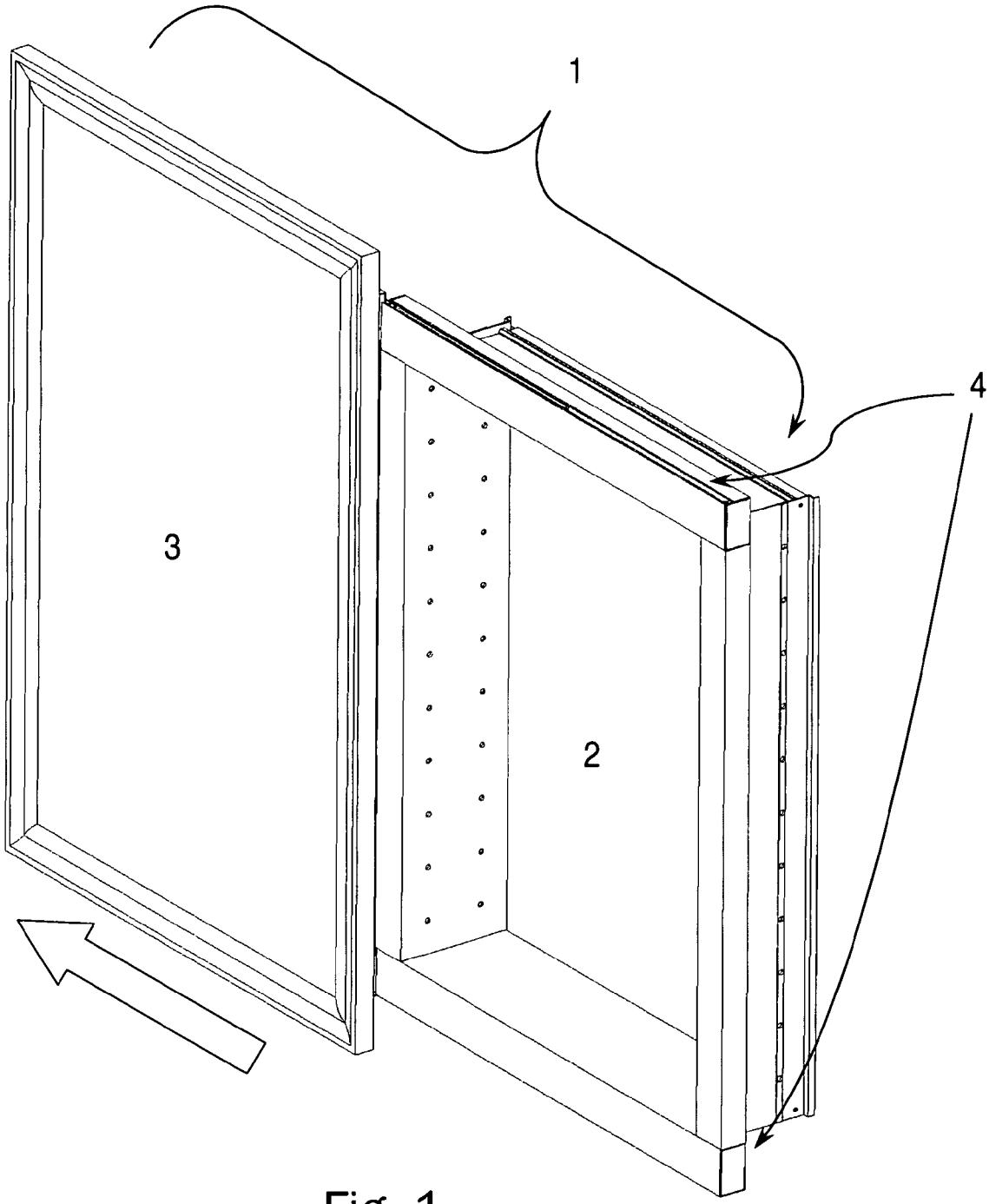
FIG. 1 is a perspective front view drawing of one embodiment of the cabinet disclosed herein showing the enclosure and the top and bottom concealed fully extendable slide assembly with the panel in the open position.

All numerical values within the detailed description and the claims herein are modified by "about" or "approximately" the indicated value, and take into account experimental error and variations that would be expected by a person having ordinary skill in the art.

Provided are improved cabinets, methods of making such cabinets and methods of using such cabinets, and in particular for use by non-ambulatory individuals. More particulary, the cabinets disclosed herein provide a means for covering the enclosure cavity of a wall recessed enclosure or a wall mounted enclosure with a horizontally slidable surface panel (i.e. a mirrored surface or decorative print). The cabinets disclosed herein included horizontally extendable slides or rails, which are integrated into the frame of the enclosure such that the slides are concealed from the view of the user. The cabinets disclosed herein also include support brackets for mounting the panel to the concealed rails. Additionally, the cabinets disclosed herein may optionally include a system for attaching the panel to the mounting rails, such as to allow vertically angular adjustment of the panel for perpendicular panel viewing while in a seated position and to support ADA compliance requirements for wheelchair accessibility.

The cabinets disclosed herein include at least one horizontally slidable closure panel interconnected to the enclosure. In one form, the cabinet disclosed herein includes a single horizontally slidable closure panel. In alternative forms, the cabinet disclosed herein may include two, three, four or five horizontally slidable closure panels. The at least one horizontally slidable closure panel interconnected to the enclosure may be chosen from a mirror, a picture, a painting, a poster, a decorative structure, a clock, a plaque, a diploma, a certificate and combinations thereof.

The cabinets disclosed herein include horizontally extendable slides or rails, which are integrated into the frame of the enclosure to allow for the closure panel to be fully extended away from the enclosure cavity to provide complete access to the enclosure cavity contents. These fully horizontally extendable slides or rails are bearing type slides. In one form, these bearing type slides may be ball slides as disclosed in U.S. Pat. No. 5,466,060, herein incorporated by reference, polymer slides as disclosed in U.S. Pat. No. 6,805,418, herein incorporated by reference, or roller slides. The bearing type slides have a travel range to allow the one or more closure panel(s) (i.e. mirror(s)) to completely slide away from the enclosure cavity allowing complete, unobstructed access to the contents of the cavity. The bearing slides and mounts also have sufficient strength to support the cantilevered mirror in the open position.

The cabinets disclosed herein may be wall mounted or recessed mounted to a wall. The cabinet may be mounted using various mounting devices, including, but not limited to, wall anchors.

To achieve compliance with a vertical mirror for both ambulatory and wheelchair users, (ADAAG A4.19.6), the cabinets disclosed herein may optionally include a large mirror (required min 74 inches top edge height and max 40 inches (34 inches for children) lower edge height). Such a large continuous mirror is often difficult to integrate into prior art cabinets with standard hinge configurations and typical faucet and lighting fixture clearance requirements. For conventional cabinets the ADAAG stipulates locating the first shelf of a cabinet at 42 inches from the floor. This positioning constraint coupled with the mirror requirements and considerations for faucet fixture clearances puts limitations on cabinet configurations that may be used. The cabinets disclosed herein address these ADAAG considerations by providing a cabinet system that may be placed low, even below the horizontal plane of faucet fixtures thereby maximizing viewing area and cabinet access for wheelchair users. The optional vertically angular adjustability panel(s) of the cabinets disclosed herein also provides a simple system for accessibility accommodating both wheelchair users and ambulatory individuals.

Figure 2:
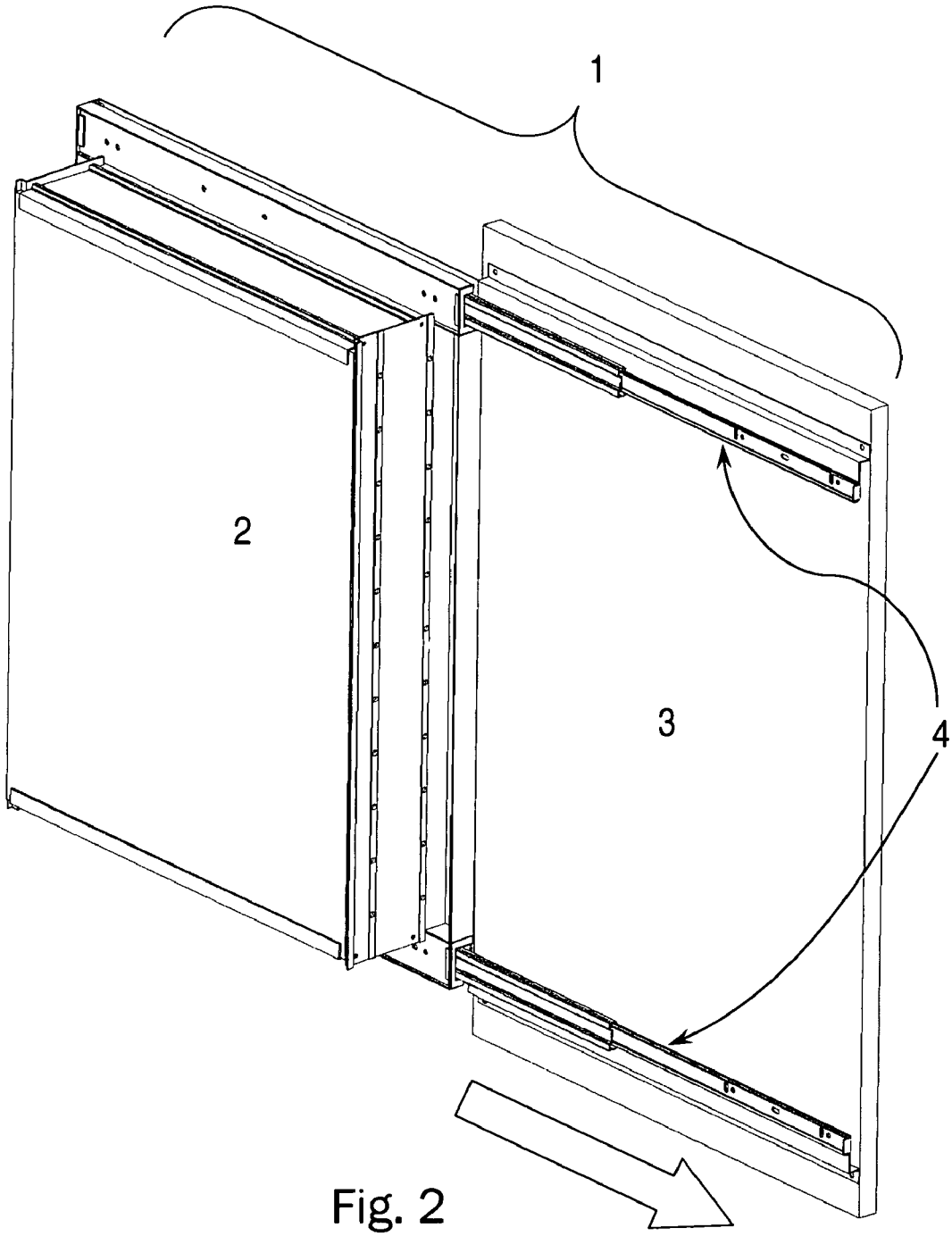
FIG. 2 is a perspective rear view drawing of the cabinet embodiment of FIG. 1 showing the enclosure and the top and bottom concealed fully extendable slide assembly with the panel in the open position.
Figure 3:
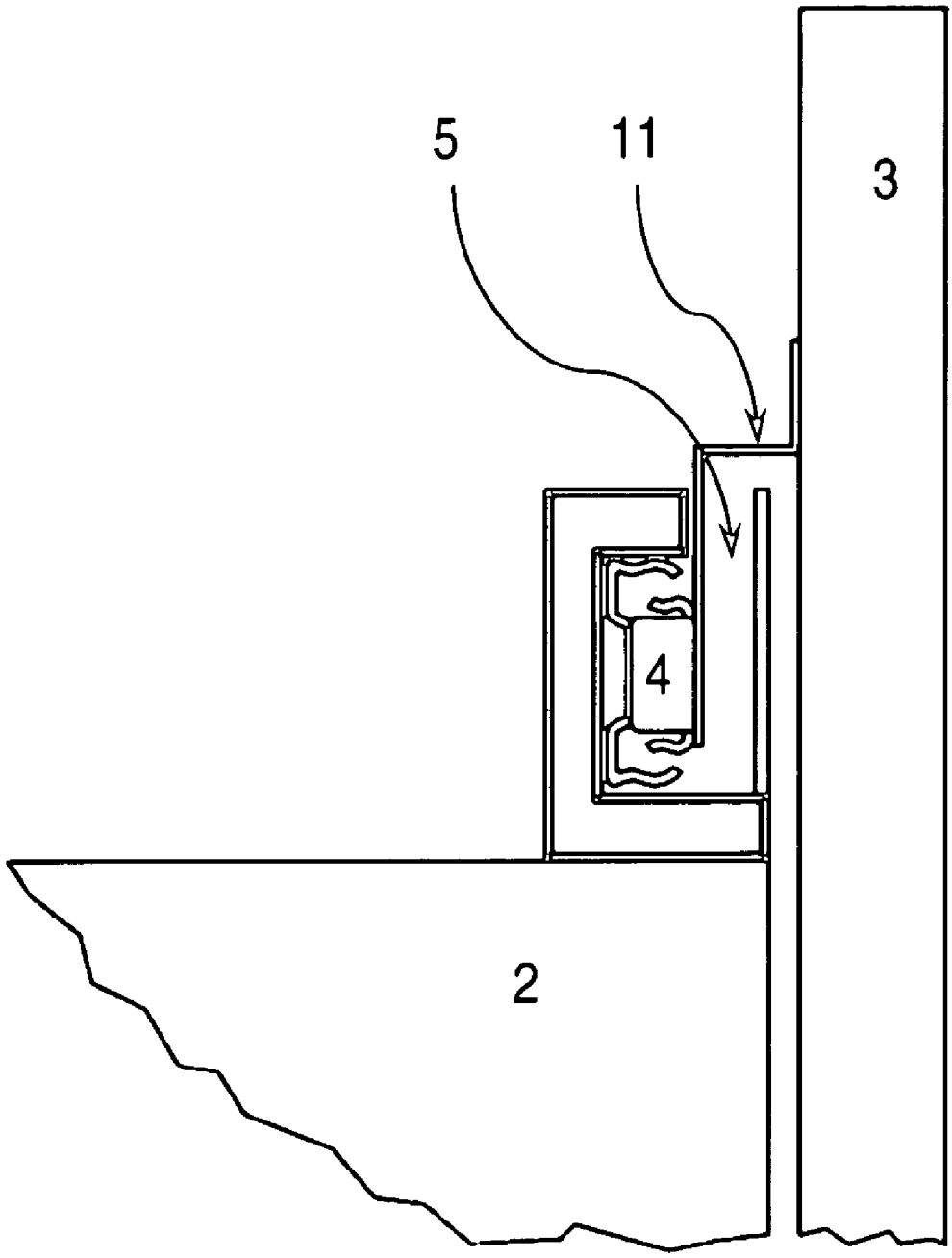
FIG. 3 is a side view drawing of the cabinet embodiment of FIG. 1 showing the top concealed fully extendable slide assembly.
Figure 4:
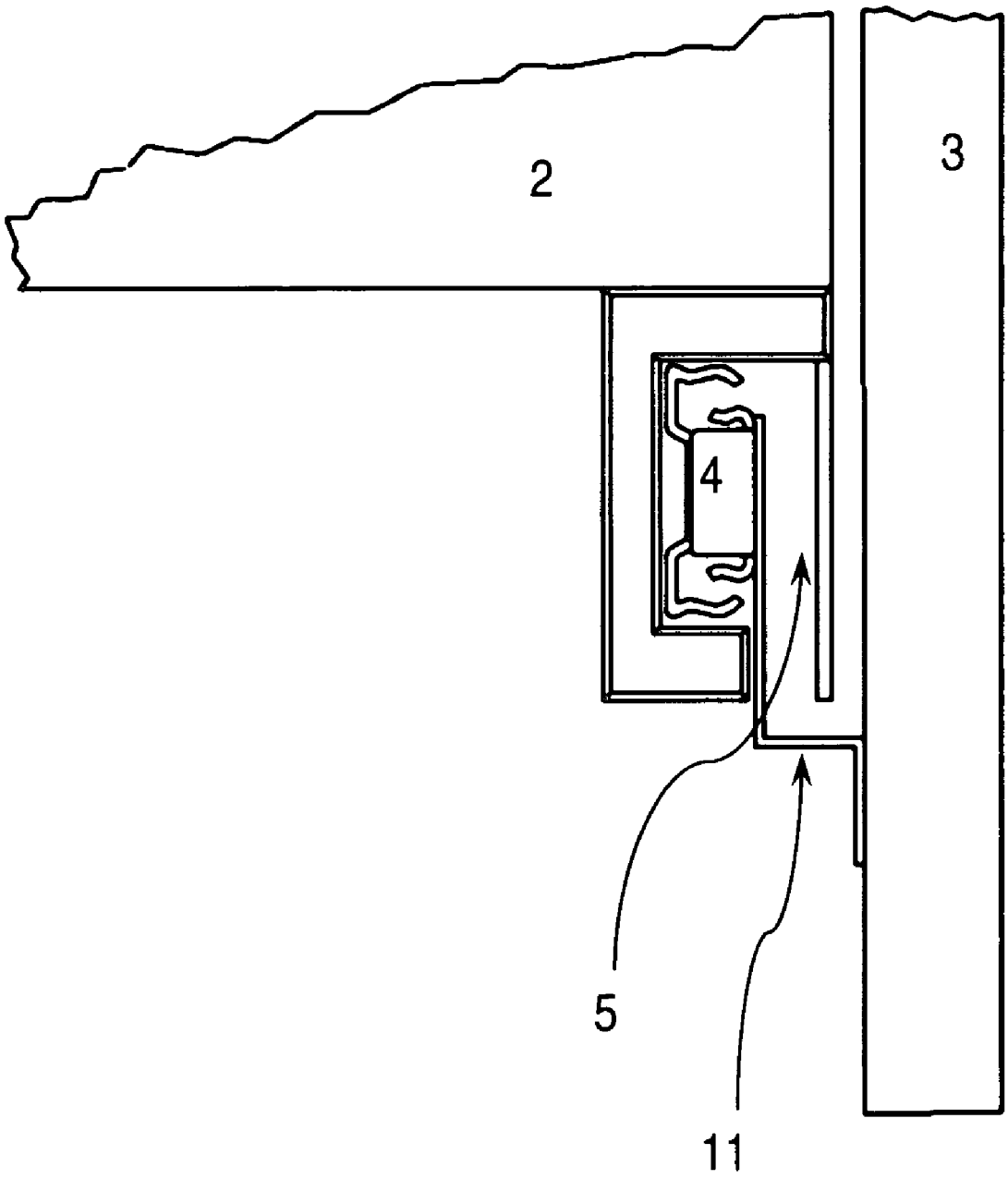
FIG. 4 is a side view drawing of the cabinet embodiment of FIG. 1 showing the bottom concealed fully extendable slide assembly.

Referencing the drawings, wherein like numerals indicate like elements and referring now to FIG. 1 and FIG. 2, there is shown a cabinet 1 comprising an enclosure 2 and at least one horizontally slidable closure panel 3 interconnected to the enclosure 2 with a first fully extendable concealed slide rail assembly 4 mounted proximate the top of the enclosure 2 (see FIG. 3). As illustrated in FIG. 4, there is a second fully extendable concealed slide rail assembly 4 mounted proximate to the bottom rail of the enclosure 2. The at least one horizontally slidable closure panel 3 may be chosen from a mirror, a picture, a painting, a poster, a decorative structure, a clock, a plaque and combinations thereof. The fully extendable concealed slide rail assemblies 4 allow sufficient movement of the closure panel 3 thereby providing unobstructed access to the internal cavity of the enclosure 2.

Figure 5:
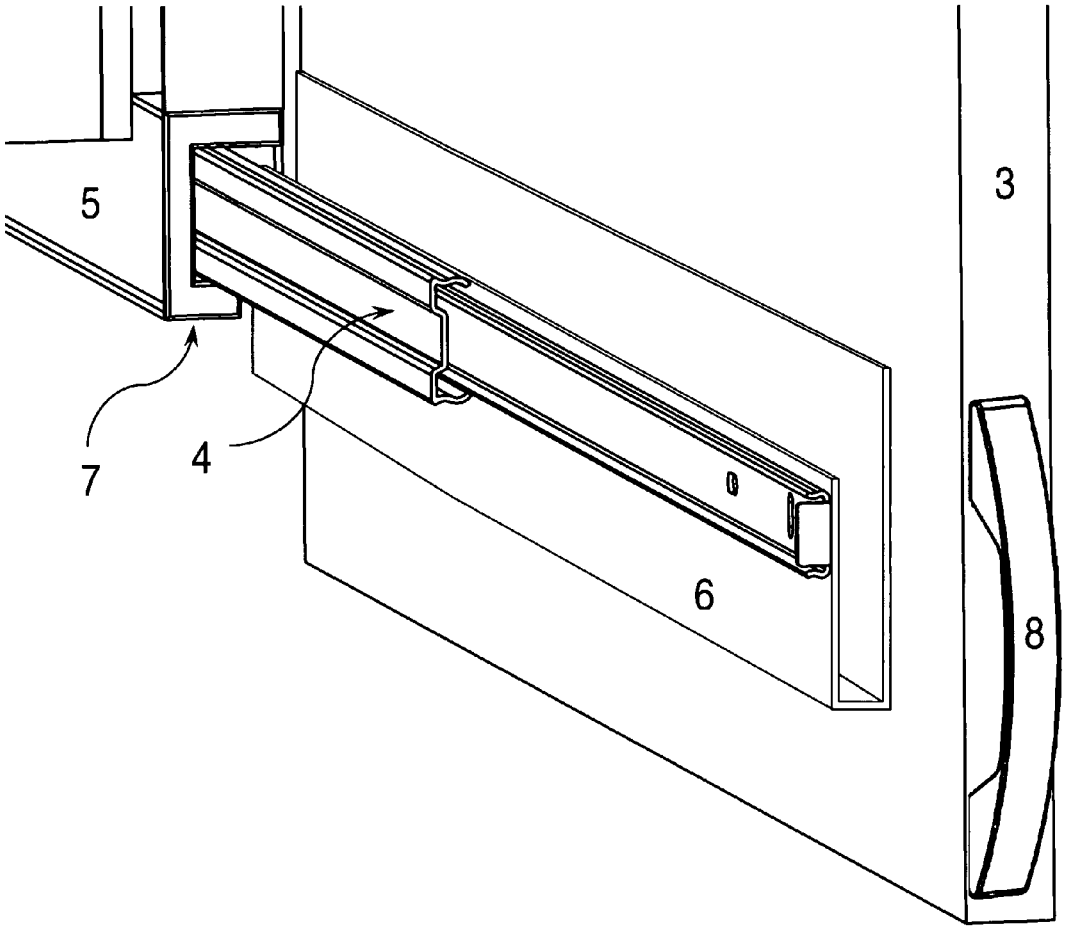
FIG. 5 is perspective view drawing of the cabinet disclosed herein depicting the bottom concealed fully extendable slide assembly in the open position and the cap at the end of the slotted channel.

The upper and lower concealed rail assemblies illustrated in FIGS. 3 and 4 each include a slotted channel 5 horizontally mounted to the enclosure 2 with an internally fully extendable slide rail mechanism 4. Referring to FIG. 5, a panel mounting bracket 6 interconnects the slidable closure panel 3 to the fully extendable segment of the internal fully extendable concealed slide bearing rail mechanism 4. The panel mounting bracket may be S-shaped 11 as shown in FIGS. 3 and 4 or U-shaped 6 as shown in FIG. 5. The fully extendable concealed slide bearing rail 4 may be of a ball bearing type, roller type or polymer slide type. As shown in FIG. 5, end caps 7 are attached to each end of the slotted channels 5 to further conceal the internal extendible slide rail mechanism 4. A control handle 8, or similarly a knob or lever may be added to the panel 3 or other translating portions of the assembly to facilitate opening and closure of the panel.

Figure 6:
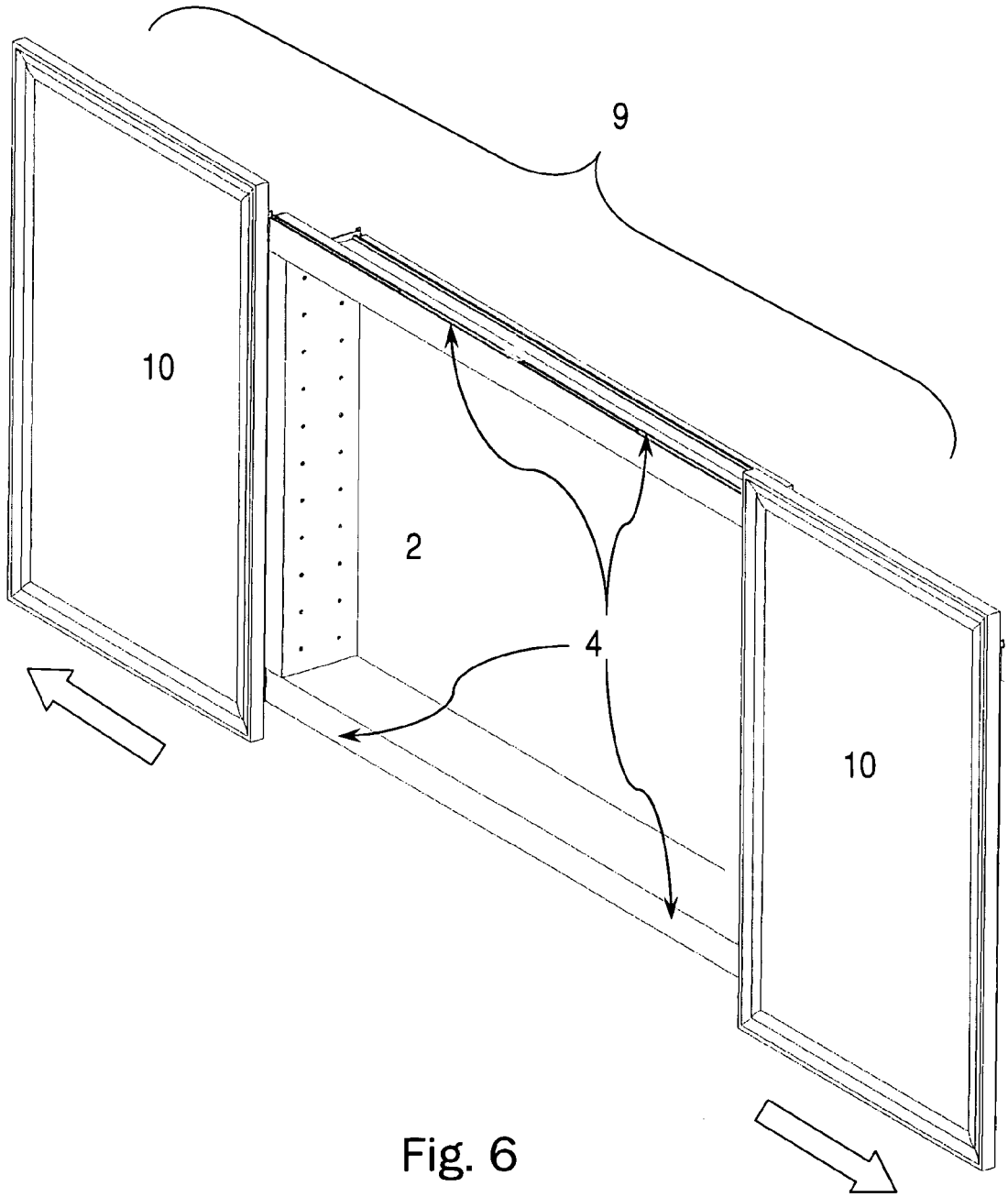
FIG. 6 is a perspective front view drawing of an alternative embodiment of the cabinet disclosed herein showing the enclosure and a pair of panels, with one panel slidable in the horizontal direction and the other panel slidable in the opposite horizontal direction and both panels in the open position.

FIG. 6 shows an alternative embodiment of the single panel cabinet shown in FIG. 1 and FIG. 2. This embodiment is a two panel cabinet 9 including a single enclosure 2 with two slidable closure panels 10, slidable in opposite horizontal directions and each mounted by fully extendable concealed slide rails assemblies 4 mounted proximate to the top and bottoms of enclosure 2 providing unobstructed access to the enclosure cavity.

Figure 7:
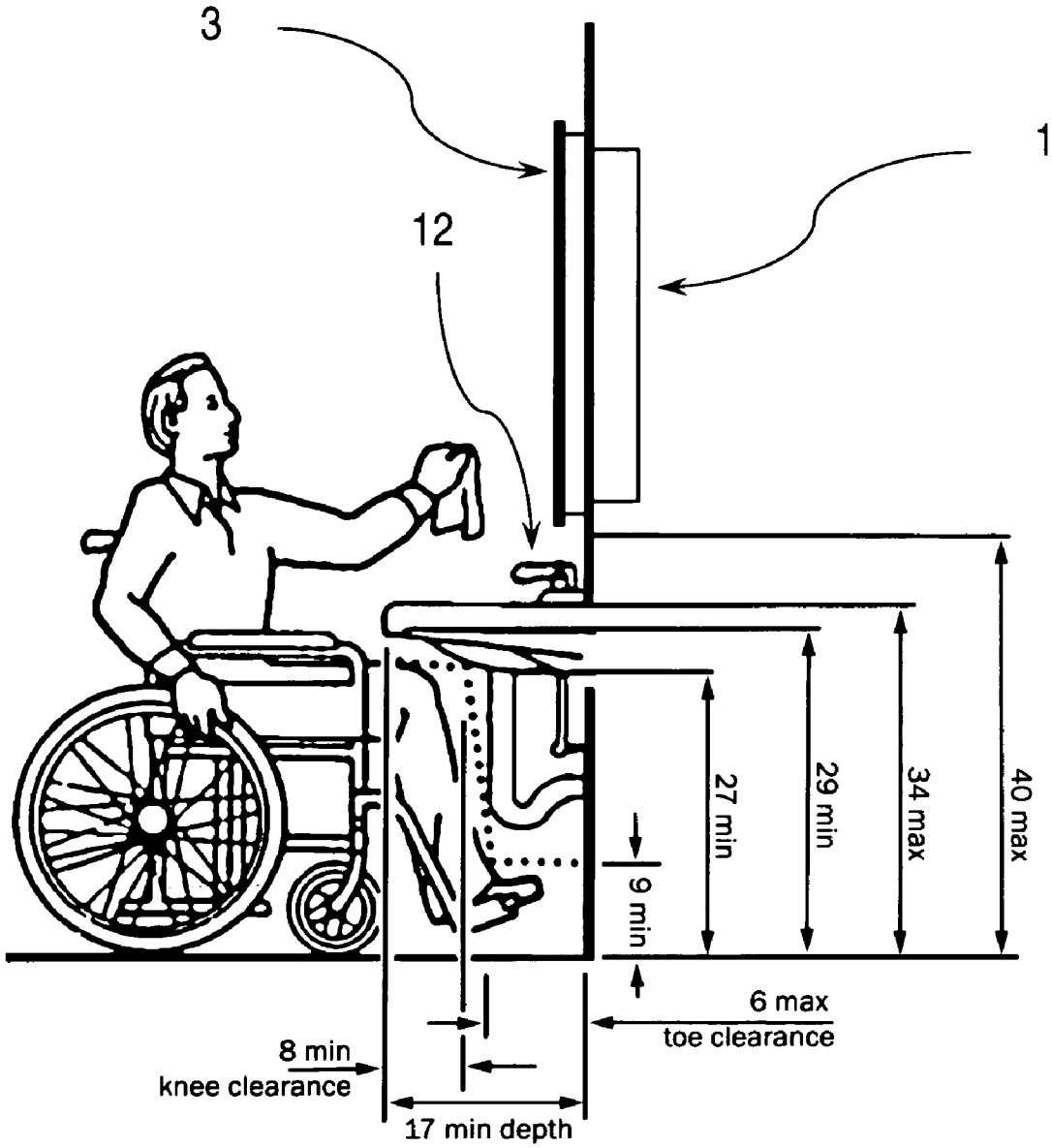
FIG. 7 is a side view drawing of the cabinet disclosed herein depicting compliance specifications (dimensions in inches) for mirror placement as per ADAAG Sections 4.19, A4.19.6.

Referring to FIG. 7, the embodiments of the cabinets disclosed herein allow for the lower mounting of the cabinet 1 relative to lavatory and bathroom fixtures 12 when used with a mirrored panel 3 as a bathroom medicine cabinet. The placement may be within guidelines for lower portion of mirrored panel placement as specified in the current Americans with Disabilities Act Accessibility Guidelines (ADAAG). FIG. 7 depicts the specifications from ADAAG Sections 4.19 indicating that the lower edge of the mirrored panel placement above a lavatory "shall be mounted with the bottom edge of the reflecting surface panel 3 no higher than 40 inches (1015 mm) above the finish floor" for adults and Section A4.19.6 specifies the placement of the lower edge of a mirror above a lavatory for children as "no higher than 34 inches (865 mm) above the finish floor or at the lowest mounting height permitted by fixtures and related elements." The cabinets disclosed herein allow the cabinet mirrored panel lower edge to be placed on the lavatory surface while still allowing access to the contents of the cabinet 1, provided there is sufficient fixture 12 clearance.

Figure 8:
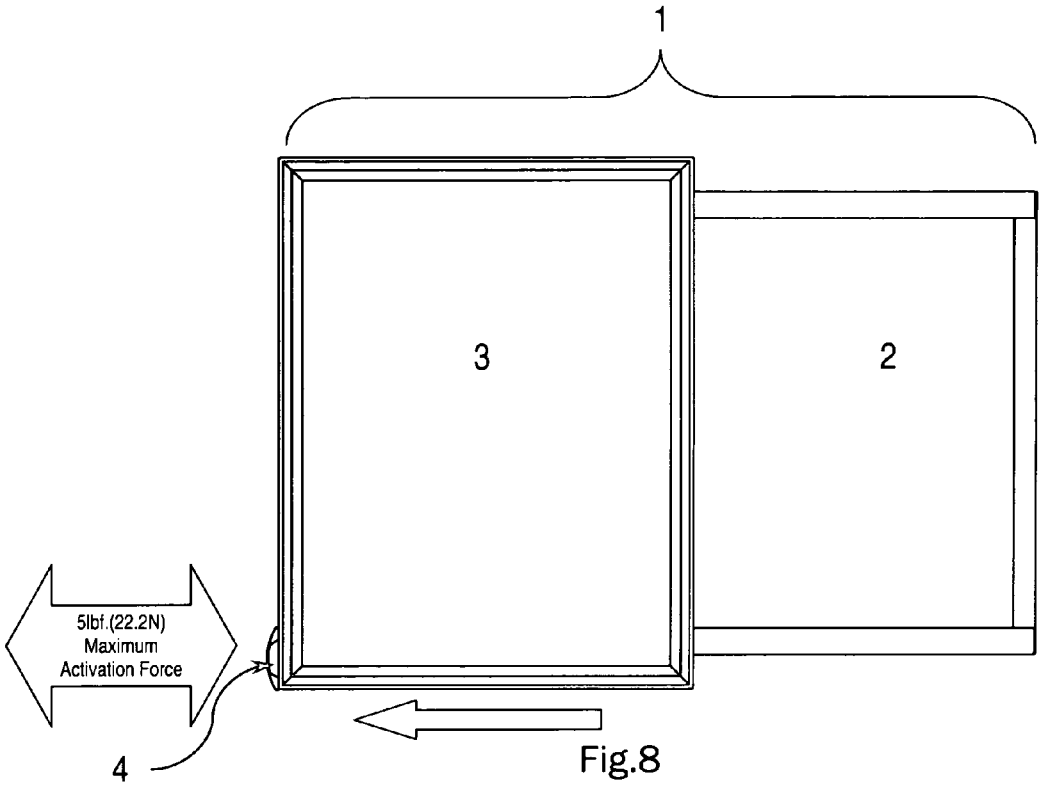
FIG. 8 is a front view of the cabinet disclosed herein showing the handle placement and force allowances for handles, levers or knobs enabling opening and closure of the slide panel per ADAAG specifications.
Figure 9:
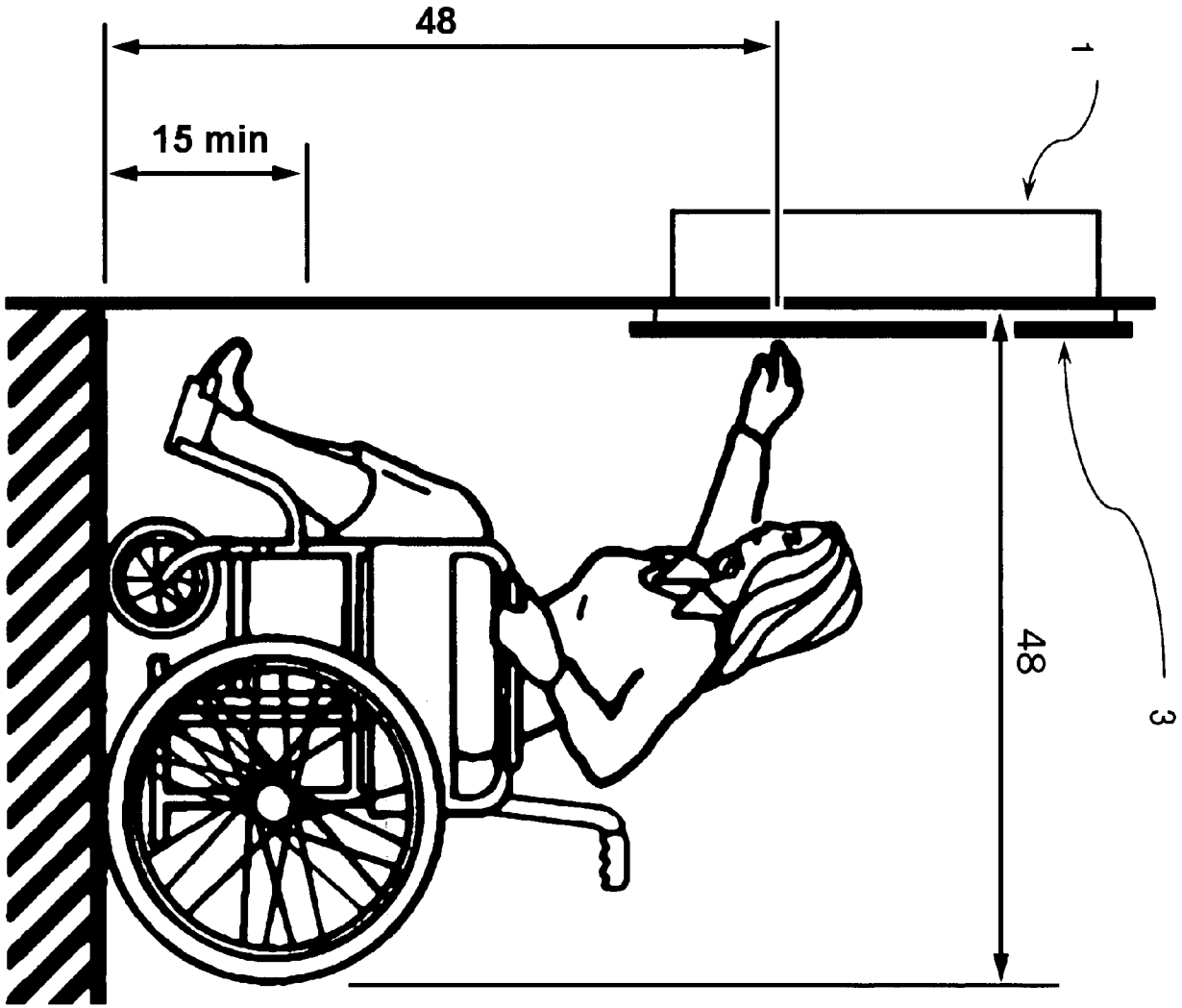
FIG. 9 is a side view of the cabinet disclosed herein depicting forward reach specifications (dimensions in inches) for controls and enclosures per ADAAG Sections 4.27.3 and 4.25.
Figure 10:
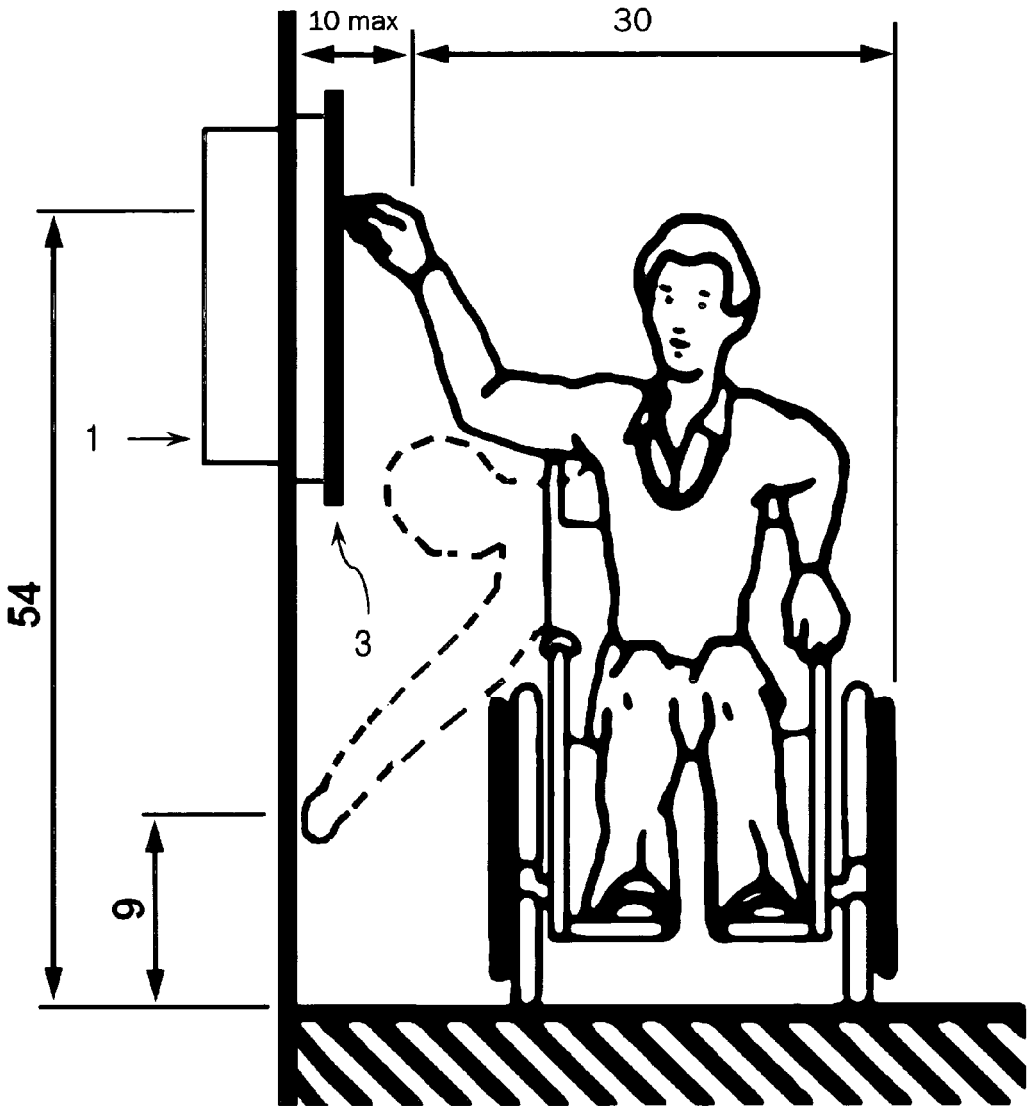
FIG. 10 is a side view of the cabinet disclosed herein depicting side reach specifications (dimensions in inches) for controls and enclosures per ADAAG Sections 4.27.3 and 4.25.

Additionally, the cabinets disclosed herein are designed to allow further compliance with Section 4.27 of the ADAAG. As indicated in FIG. 8, the cabinet 1 complies with Section 4.27.4 with 5 $lb_f$ maximum force for opening and closing of the horizontally slidable enclosure panel 3 and shall be operable with one hand and shall not require tight grasping, pinching, or twisting of the wrist. Further, the placement of the control U-handle 8 or similarly ADAAG compliant handle on the cabinet will be on the lower 8 inch portion of the mirror panel between the maximum allowable lower position of the reflecting surface and the maximum allowable forward reach limits. This is within controls accessibility limits per ADAAG Section 4.27.3 specifications as depicted in FIG. 9 of maximum high forward reach of 48 in (1220 mm) and as in FIG. 10 for a maximum high side reach of 54 inches (1370 mm). The design may also facilitate accessibility to the enclosure cavity in compliance with ADAAG Section 4.25 with the same reach requirements as specified above.

Figure 11:
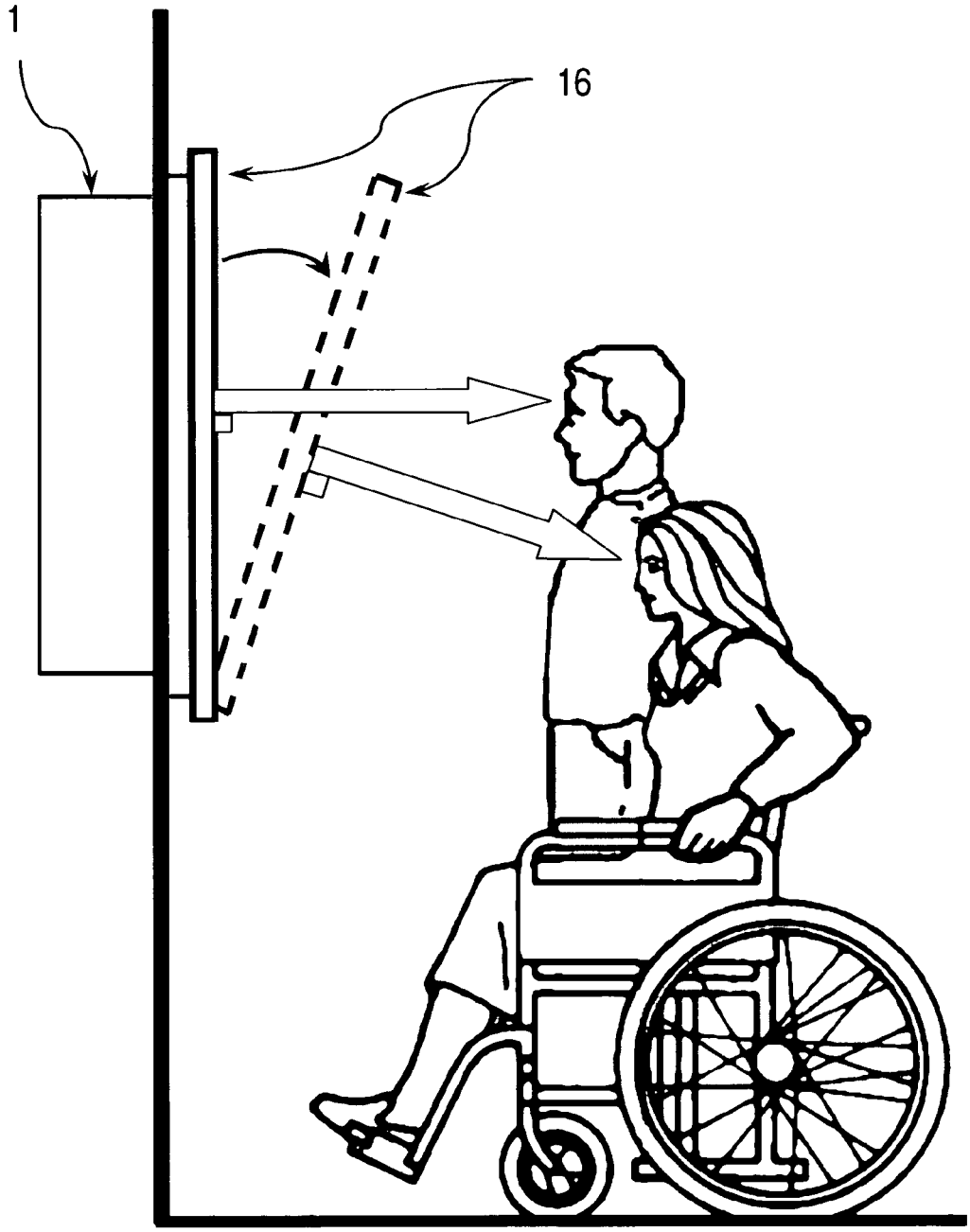
FIG. 11 is a perspective side view drawing of an alternative embodiment of the cabinet disclosed herein showing the side view of the enclosure and top and bottom concealed fully extendable slide assembly and the panel vertically angular adjustment mechanism with the panel in the open position for individuals in wheelchairs and closed for ambulatory individuals.

Additional embodiments of the cabinet designs previously described include mechanisms for adjusting the panel angular position downward from vertical plane of the enclosure. Such a design when used within ADAAG-compliance guidelines may further facilitate usage by wheelchair users as well as ambulatory persons by allowing the adjustment of the normal reflective viewing plane of the panel surface as depicted in FIG. 11. Referring to FIG. 11, an angularly adjustable closure panel 16 of the cabinet 1 provides for ease of adjustment of the normal reflective viewing plane when the closure panel 16 is a mirror.

Figure 12:
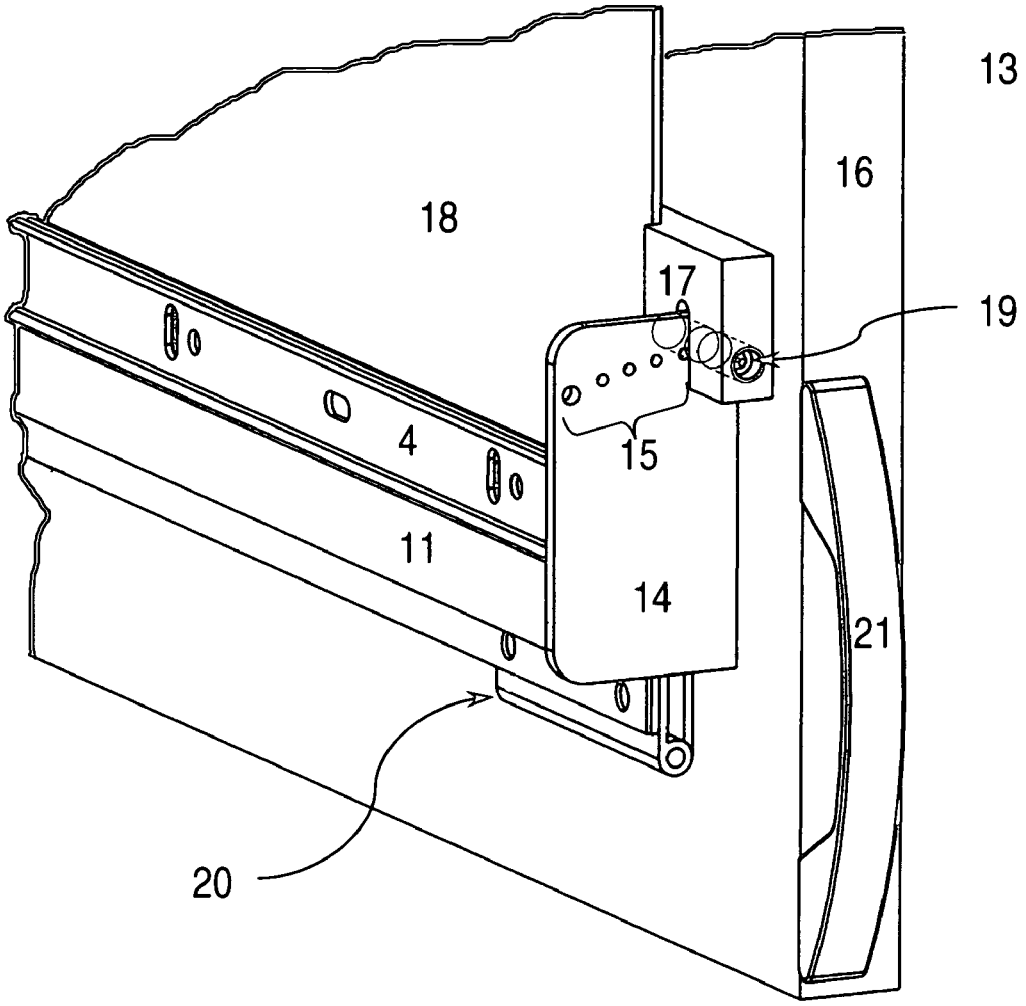
FIG. 12 is a side view drawing of the cabinet embodiment of FIG. 11 depicting the panel vertically angular adjustment mechanism with the panel in the vertical position.
Figure 13:
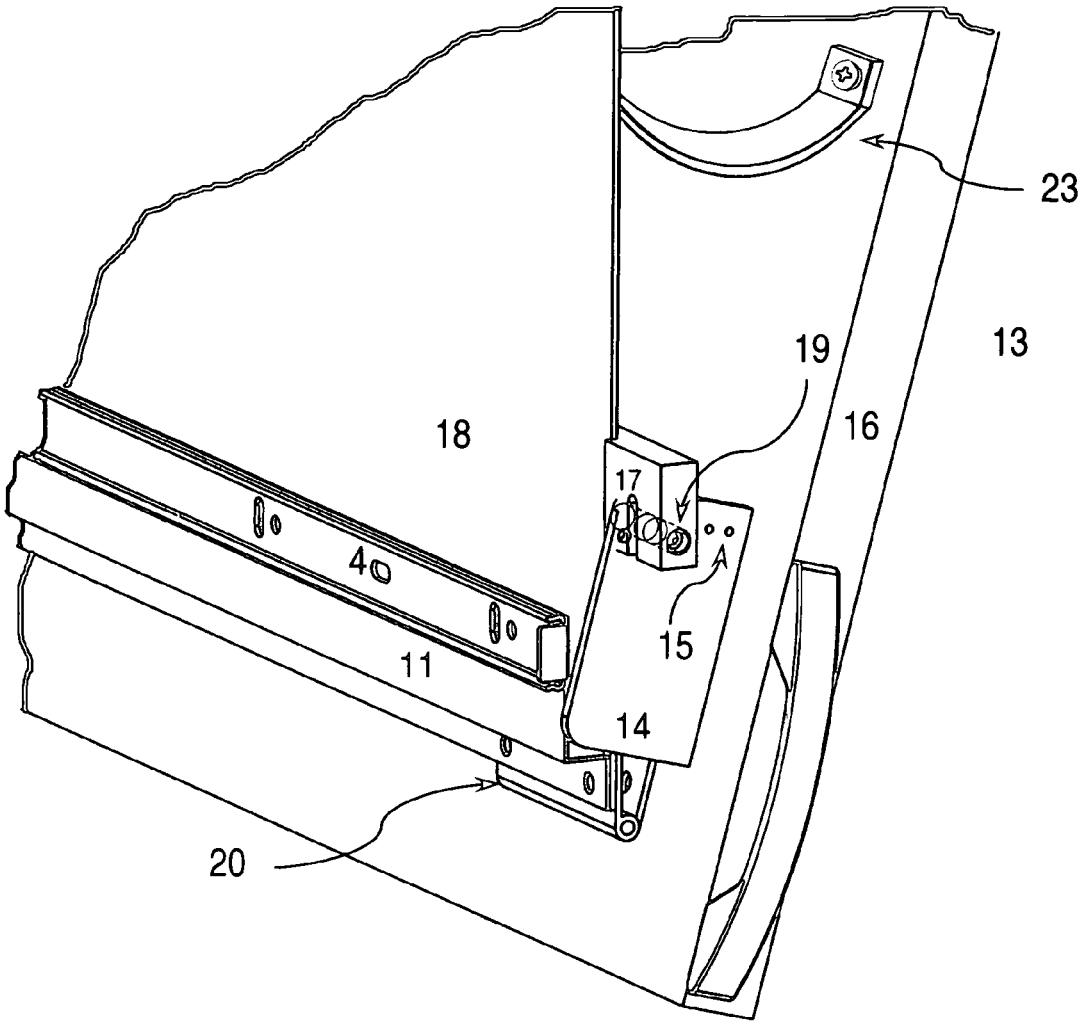
FIG. 13 is a side view drawing of the cabinet embodiment of FIG. 12 depicting the panel vertically angular adjustment mechanism with the panel angled in the non-vertical position.

One advantageous embodiment of a vertically angular adjustment mechanism for the closure panel 13 as depicted in FIG. 12 includes at least one detent block 14 having multiple detent holes 15 or recesses mounted to the at least one horizontally slidable and angularly adjustable closure panel 16 and at least one ball plunger block 17 mounted to the at least one enclosure cover plate 18 including at least one spring-loaded ball plunger 19, wherein the at least one ball plunger block 17 is positioned proximate the at least one detent block 14 to allow alignment of the at least one spring loaded ball plunger 19 and the at least one detent block 14 to permit discrete angular positioning of the at least one horizontally slidable and angularly adjustable closure panel 16. This advantageous embodiment may also include at least one spring loaded hinge 20 proximate the bottom edge of the enclosure 2 and mounted at one end to the at least one horizontally slidable and angularly adjustable closure panel 16 and at the other end to the at least one enclosure cover plate 18. At least one handle 21, adjustment lever arm, or knob interconnects to the panel for adjusting the angle of the at least one horizontally slidable and angularly adjustable closure panel 16. The cabinet incorporated with the angular adjustability may also be designed within the ADAAG compliance specifications previously discussed. FIG. 12 and FIG. 13 show the manner of adjustment of the panel using the angular adjustment mechanism described. The range of angular adjustment is typically, but not limited to, 0 degrees to 30 degrees and may be limited by at least one safety cable 23, safety strap, sliding safety bracket or gas cylinder interconnecting the enclosure cover plate 18 to the at least one horizontally slidable and angularly adjustable closure panel 16. The enclosure cover plate 18 may be attached to the upper and lower fully extendable concealed slide rail assemblies 4 using an S-bracket 11 or U-bracket 6 in the same fashion as the horizontally adjustable panel 3 is attached to the upper and lower fully extendable concealed slide rail assemblies 4 in the previous, angularly fixed cabinet embodiment.

Figure 14:
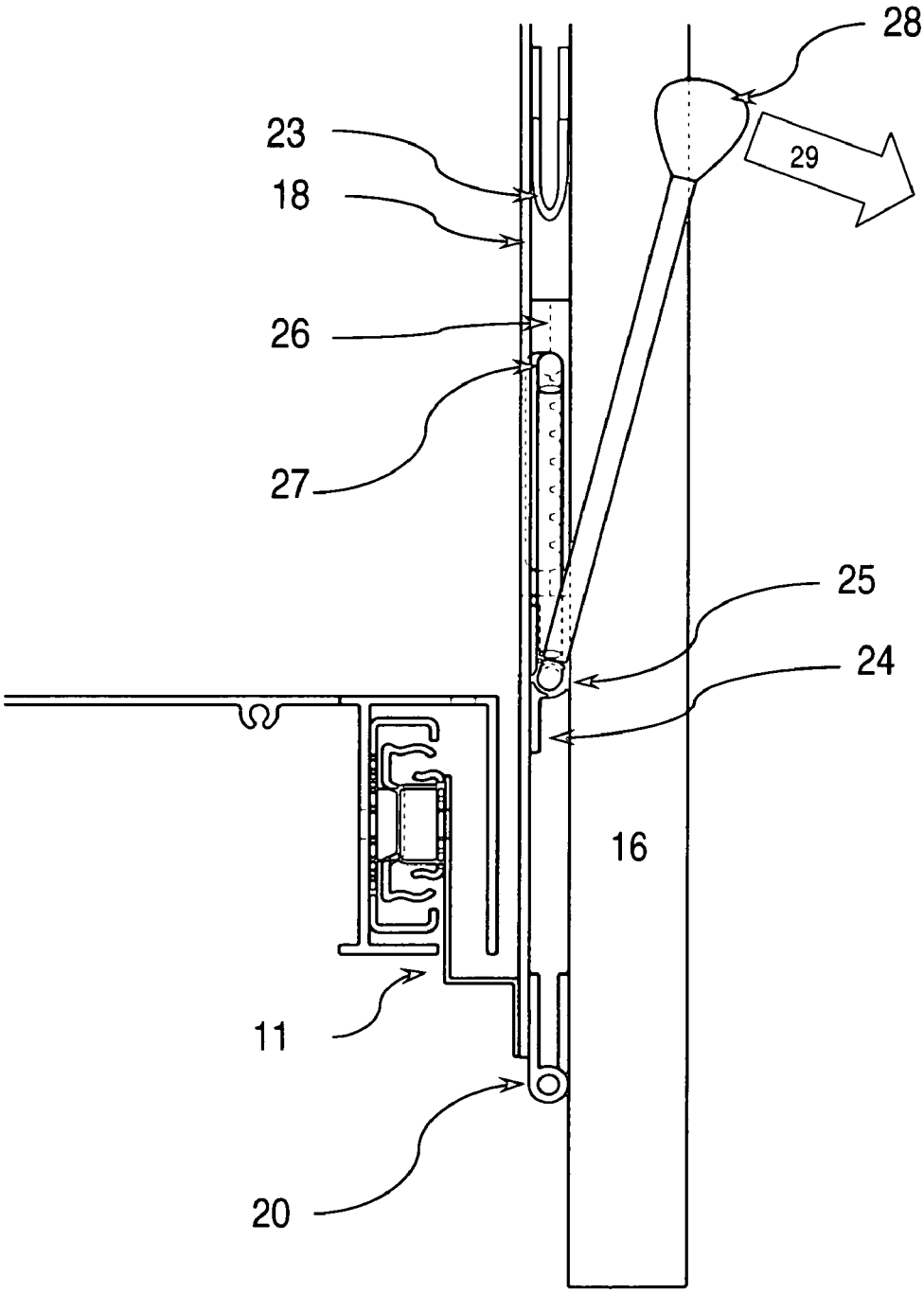
FIG. 14 is a side view drawing of another alternative embodiment of the cabinet disclosed herein with an alternative panel vertically angular adjustment mechanism with the panel in the vertical position.
Figure 15:
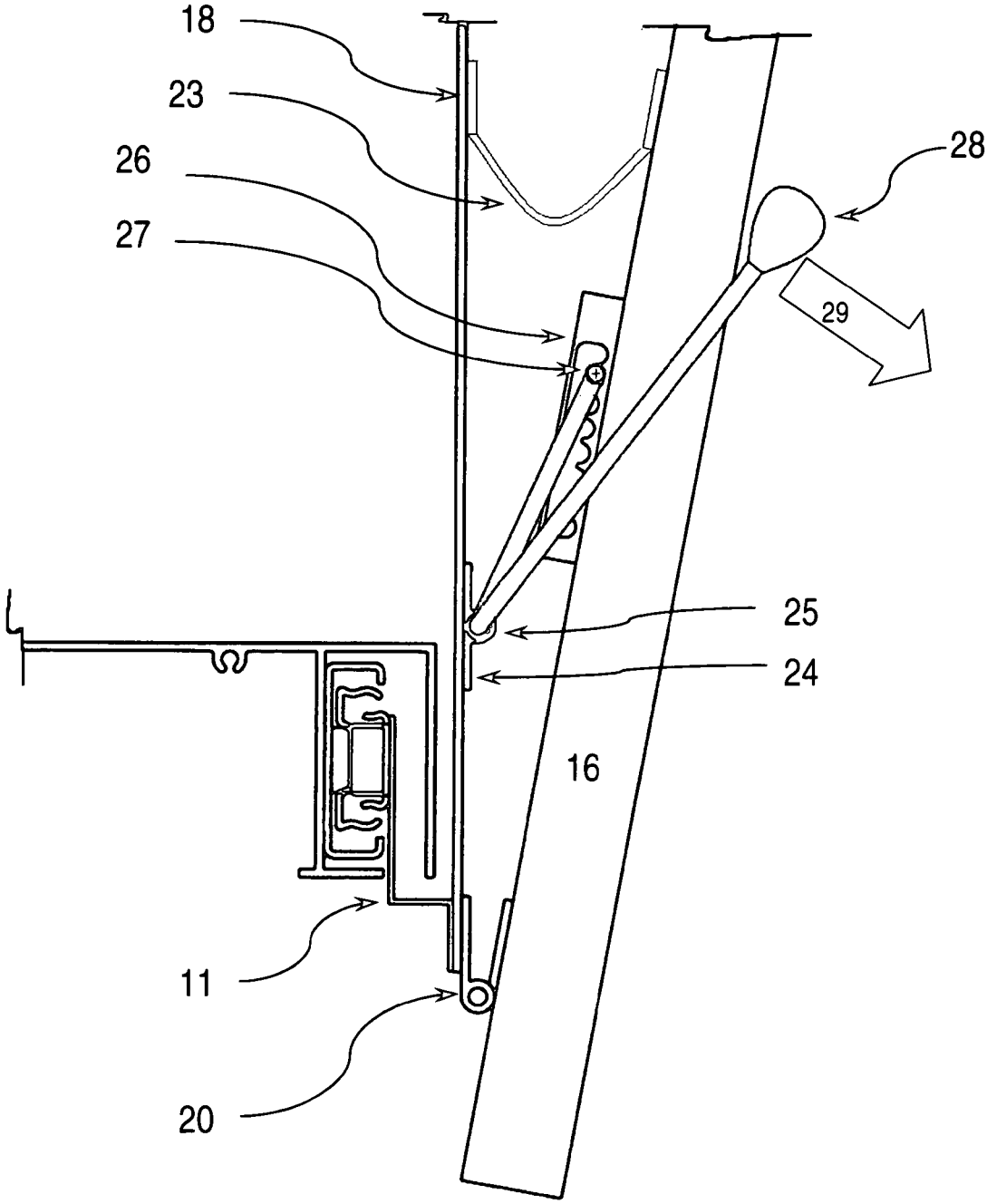
FIG. 15 is a side view drawing of the cabinet embodiment of FIG. 14 depicting the alternative panel vertically angular adjustment mechanism with the panel angled in the non-vertical position.

An alternate embodiment of an angular adjustment mechanism for the closure panel 16 are depicted in FIGS. 14-15 and includes a bushing mounting block 24 and bushing 25 mounted to at least one enclosure cover plate 18, with a least one spring loaded hinge 20 mounted to at least one horizontally slidable and angularly adjustable closure panel 16 and at the end to at least one enclosure cover plate 18. At least one detent type roller guide 26 mounted to the back of the at least one horizontally slidable and angularly adjustable closure panel 16 and interconnected to the bushing 25 and mounting block 24 with a roller arm 27, and at least one adjustment lever arm 28 interconnected to the bushing 25 and mounting block 24 is used for adjusting the angle of the at least one horizontally slidable and angularly adjustable closure panel 16. Applying a force 29 to the lever arm 28 allows angular adjustment of the horizontally slidable and angularly adjustable closure panel 16 as shown in FIG. 15. The enclosure cover plate 18 as in the previously discussed angularly adjustable embodiment may be attached to upper and lower fully extendable concealed slide rail assemblies 4 using an S-bracket 11 or U-bracket 6. The range of angular adjustment as in the previously discussed embodiment is typically, but not limited to, from 0 degrees to 30 degrees and may be limited by at least one safety cable 23, safety strap, sliding safety bracket or gas cylinder interconnecting the enclosure cover plate 18 to the at least one horizontally slidable and angularly adjustable closure panel 16. The cabinet incorporated with this embodiment of the angular adjustability may also be designed within the ADAAG compliance specifications previously discussed.

Figure 16:
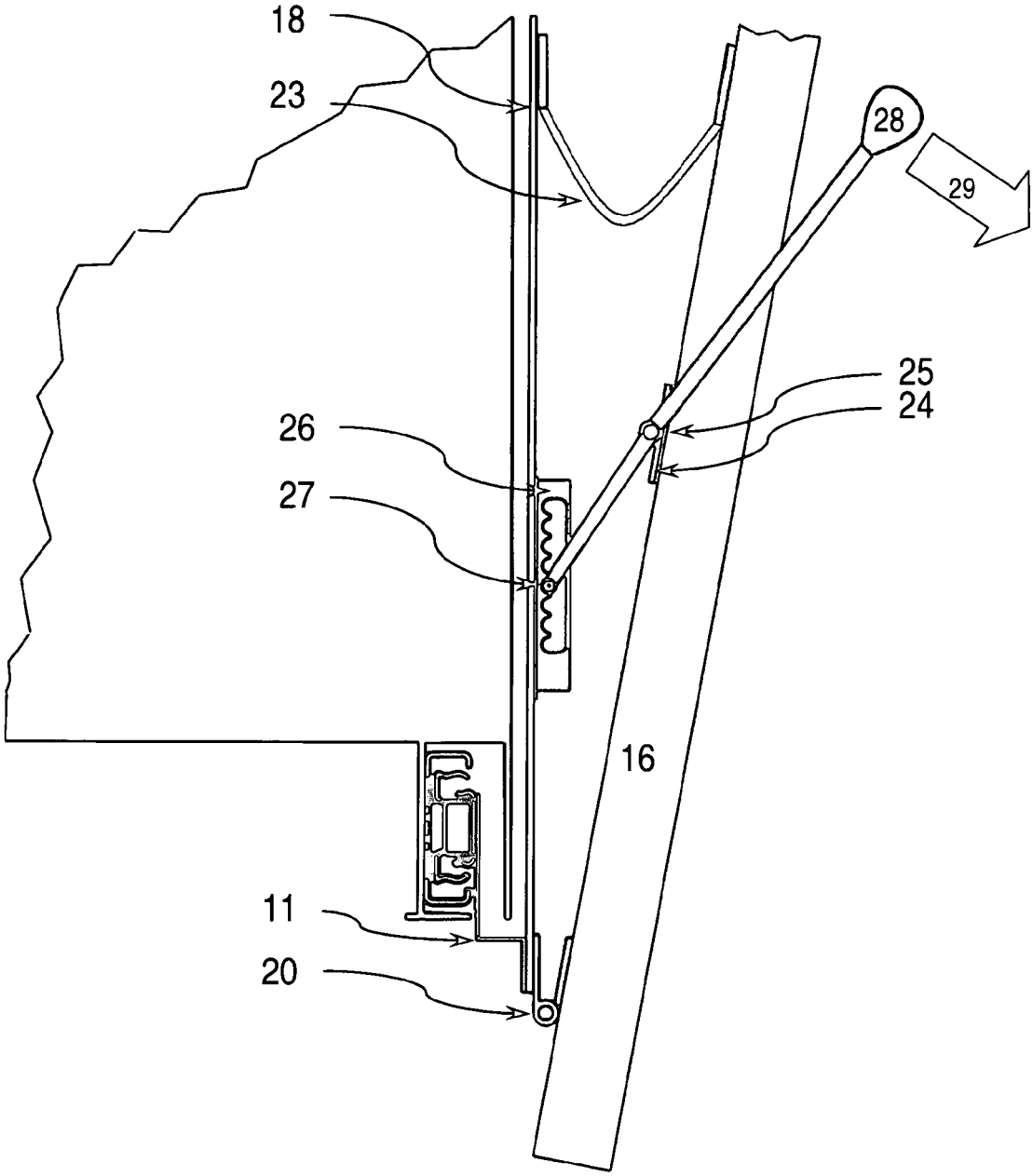
FIG. 16 is side view drawing of another alternative embodiment of the cabinet disclosed herein with an alternative panel vertically angular adjustment mechanism with the panel angled in the non-vertical position.

Referring to FIG. 16, an alternative embodiment of the vertically angular adjustment mechanism depicted in FIG. 14, includes a bushing mounting block 24 and bushing 25 mounted to the angularly adjustable closure panel 16, instead of the least one enclosure cover plate 18 (as previously described in FIGS. 14-15). The embodiment of FIG. 16 also has at least one spring loaded hinge 20 mounted to at least one horizontally slidable and angularly adjustable closure panel 16 and at the end to at least one enclosure cover plate 18. At least one detent type roller guide 26 is mounted to the least one enclosure cover plate 18 instead of the back of the at least one horizontally slidable and angularly adjustable closure panel 16 (as previously described in FIGS. 14-15). Similarly, it is interconnected to the bushing 25 and mounting block 24 with a roller arm 27, and at least one adjustment lever arm 28 interconnected to the bushing 25 and mounting block 24 for adjusting the angle of the at least one horizontally slidable and angularly adjustable closure panel 16. Similarly, applying a force 29 to the lever arm 28 allows vertically angular adjustment of the horizontally slidable and angularly adjustable closure panel 16.

One step of the assembly process for the cabinets disclosed herein involves the attachment of the upper and lower fully extendable slide rail mechanisms 4 to the enclosure 2 and the subsequent assembly of the upper and lower S-bracket 11 or U-bracket 6 between the upper and lower fully extendable slide rail mechanisms 4 and the panel 3 or alternately the enclosure cover plate 18. Proper assembly may provide for smooth horizontal travel of the panels 3, 10, 16 and their respective assemblies. Improper assembly and vertical or horizontal misalignment of the upper and lower components may result in binding of the components during horizontal movement of the assemblies, thereby exceeding the limits of 5 lbf maximum force allowed for control of opening and closure as per ADAAG Section 4.27.4 limits. The allowable misalignment for the mounting of cabinet components may be a function of the deflection of materials, misalignment tolerances allowed between moving components, as well as the overall dimensions of the components. Fixtures should be utilized to ensure alignment of the S-channel 11 or U-channel 6 to the fully extendable slide rail assemblies. These fixtures should align horizontal and vertical datums on the slide rails to horizontal and vertical datums on the S-channels or U-channels prior to fastening these components together. To ensure fully extendable slide rail alignment, a fixture device may be utilized to vertically align like mounting holes located on the upper and lower fully extendable slide rail assemblies and align horizontal datums of each of the upper and lower fully extendable slide rail assemblies to each other and to the horizontal enclosure datums. Next, the panel 3 or alternately the enclosure cover plate 18 may be attached to the upper and lower U-channel or S-channel brackets using fixtures to ensure horizontal and vertical positioning relative to the enclosure and brackets. Care should be taken during this process to minimize preloading of the fully extendable slide rail assemblies, further ensuring compliance within ADAAG Section 4.27.4 force limits during final assembly testing.

The Applicant has attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

When numerical lower limits and numerical upper limits are listed herein, ranges from any lower limit to any upper limit are contemplated.

What is claimed is:

1. A cabinet comprising:

an enclosure, at least one enclosure cover plate, at least one horizontally slidable and vertically angularly adjustable closure panel interconnected to the enclosure with a first fully extendible concealed rail slide assembly mounted proximate the top of the at least one enclosure cover plate and a second fully extendible concealed rail slide assembly mounted proximate the bottom of the enclosure or the at least one enclosure cover plate to provide complete access to the enclosure contents, and an angular adjustment mechanism for vertically tilting the least one horizontally slidable and vertically angularly adjustable closure panel, wherein the first and second fully extendible concealed rail slide assemblies each include:

a slotted channel horizontally mounted to the enclosure with an internal fully extendible slide bearing rail mechanism, a panel mounting bracket interconnected at one end to the back surface of the at least one enclosure cover plate and at the other end to the extendible rail of the internal fully extendible slide bearing rail mechanism, and caps at each end of each slotted channel to conceal the internal fully extendible slide bearing rail mechanism.

2. The cabinet of claim 1, wherein the angular adjustment mechanism includes:

at least one detent block including multiple detent holes or recesses mounted at one end to the at least one horizontally slidable and vertically angularly adjustable closure panel and at the other end to the at least one cover plate, at least one ball plunger block mounted to the at least one enclosure cover plate including at least one spring-loaded ball plunger, wherein the at least one ball plunger block is positioned proximate the at least one detent block to allow alignment of the at least one spring loaded ball plunger and the at least one detent block to permit discrete angular positioning of the at least one horizontally slidable and vertically angularly adjustable closure panel, at least one spring loaded hinge proximate the bottom edge of the enclosure and mounted at one end to the at least one horizontally slidable and vertically angularly adjustable closure panel and at the other end to the at least one enclosure cover plate, and at least one adjustment lever arm or handle interconnected to the at least one horizontally slidable and vertically angularly adjustable closure panel for adjusting the vertical angle of the at least one horizontally slidable and vertically angularly adjustable closure panel along the at least one detent block.

3. The cabinet of claim 2, wherein the at least one adjustment lever arm is located proximate a bottom edge of the at least one horizontally slidable and vertically angularly adjustable closure panel for ease of access and adjustment by non-ambulatory people.

4. The cabinet of claim 1, further including at least one safety strap, safety cable, sliding safety bracket or safety gas cylinder interconnected between the at least one enclosure cover plate at one end and the at least one horizontally slidable and vertically angularly adjustable closure panel at the other end for limiting the angular adjustment of the closure panel.

5. The cabinet of claim 1, wherein the panel mounting bracket is a u-shaped bracket or an s-shaped bracket.

6. The cabinet of claim 1, wherein the internal fully extendible slide bearing rail mechanism includes ball slides, roller slides or polymer slides.

7. The cabinet of claim 1, wherein the enclosure is mountable within a wall recess or on the surface of a wall.

8. The cabinet of claim 1, wherein the at least one horizontally slidable and vertically angularly adjustable closure panel is a single panel.

9. The cabinet of claim 8, wherein the single panel fully extends to provide unobstructed access to a cavity of the enclosure.

10. The cabinet of claim 1, wherein the at least one horizontally slidable and vertically angularly adjustable closure panel is a pair of panels with one slidable outward from the enclosure in one horizontal direction and the other slidable outward from the enclosure in the opposite horizontal direction.

11. The cabinet of claim 10, wherein the pair of panels fully extend to provide unobstructed access to a cavity of the enclosure.

12. The cabinet of claim 1, wherein the at least one horizontally slidable closure panel is chosen from a mirror, a picture, a painting, a poster, a decorative structure, a clock, a plaque, a diploma, a certificate and combinations thereof.

13. A cabinet comprising:

an enclosure, at least one enclosure cover plate, at least one horizontally slidable and vertically angularly adjustable closure panel interconnected to the enclosure with a first fully extendible concealed rail slide assembly mounted proximate the top of the at least one enclosure cover plate and a second fully extendible concealed rail slide assembly mounted proximate the bottom of the enclosure or the at least one enclosure cover plate, and an angular adjustment mechanism for vertically tilting the least one horizontally slidable and vertically angularly adjustable closure panel, wherein the angular adjustment mechanism includes:

at least one detent block including multiple detent holes or recesses mounted at one end to the at least one horizontally slidable and vertically angularly adjustable closure panel and at the other end to the at least one cover plate, at least one ball plunger block mounted to the at least one enclosure cover plate including at least one spring-loaded ball plunger, wherein the at least one ball plunger block is positioned proximate the at least one detent block to allow alignment of the at least one spring loaded ball plunger and the at least one detent block to permit discrete angular positioning of the at least one horizontally slidable and vertically angularly adjustable closure panel, at least one spring loaded hinge proximate the bottom edge of the enclosure and mounted at one end to the at least one horizontally slidable and vertically angularly adjustable closure panel and at the other end to the at least one enclosure cover plate, and at least one adjustment lever arm or handle interconnected to the at least one horizontally slidable and vertically angularly adjustable closure panel for adjusting the vertical angle of the at least one horizontally slidable and vertically angularly adjustable closure panel along the at least one detent block.

* * * * *